US005445468A

United States Patent [19]

Pacione

[11] Patent Number: 5,445,468

[45] Date of Patent: Aug. 29, 1995

[54] TWO-PIECE PRESENTATION FOLDER

[76] Inventor: Peter L. Pacione, 755/20 The Queensway East, Mississauga, Ontario, Canada, L4Y4C5

[21] Appl. No.: 142,962

[22] Filed: Oct. 29, 1993

[30] Foreign Application Priority Data

Nov. 5, 1992 [CA] Canada ..... 2082251

[51] Int. Cl.[6] ..... B42F 13/38

[52] U.S. Cl. ..... 402/75; 281/29; 402/73

[58] Field of Search ..... 402/73–75; 281/36, 29, 37; 206/576, 223, 232; 40/359; 229/1.5 R

[56] References Cited

U.S. PATENT DOCUMENTS

| | | | |
|---|---|---|---|
| 981,366 | 1/1911 | Boyce . | |
| 3,516,599 | 6/1970 | Buttery . | |
| 3,643,363 | 2/1972 | Biro . | |
| 3,809,485 | 5/1974 | Beyer | 402/75 X |
| 3,933,294 | 1/1976 | Meenan et al. . | |
| 4,262,838 | 4/1981 | MacKenzie . | |
| 4,477,838 | 10/1984 | Herrin . | |
| 4,750,609 | 6/1988 | Felis . | |
| 4,990,017 | 2/1991 | Rotherham | 402/75 |
| 5,025,978 | 6/1991 | Pacione . | |
| 5,104,250 | 4/1992 | Pacione . | |
| 5,116,081 | 5/1992 | Mann, Jr. | 402/73 X |
| 5,120,149 | 6/1992 | Smith . | |
| 5,158,387 | 10/1992 | Davies | 402/73 X |
| 5,267,804 | 12/1993 | Baumgarten | 402/73 X |

FOREIGN PATENT DOCUMENTS

| | | | |
|---|---|---|---|
| 912579 | 8/1946 | France . | |
| 494596 | 3/1930 | Germany . | |
| 2602271 | 8/1977 | Germany . | |
| 3027949 | 2/1981 | Germany . | |
| 3707675 | 9/1987 | Germany . | |
| 656838 | 7/1986 | Switzerland . | |
| 1035855 | 7/1966 | United Kingdom | 402/75 |
| 1044012 | 9/1966 | United Kingdom . | |
| 2233604 | 1/1991 | United Kingdom | 402/75 |

*Primary Examiner*—Frances Han

*Attorney, Agent, or Firm*—Riches, McKenzie & Herbert

[57] ABSTRACT

This invention relates to a kit for assembly into a portfolio folder. The kit includes a separate first panel comprising a first rectangular sheet having a first elongate spline portion along a first side edge thereof delineated, from a remaining first rectangular portion of the first panel, by a hinge-forming scoreline parallel to the first side edge. The first spline portion has a longitudinally spaced plurality of first openings. The kit includes a like separate second panel comprising a second rectangular sheet having a second elongate spline portion along a second side edge thereof delineated, from a remaining second rectangular portion of the second panel, by a hinge-forming scoreline parallel to the second side edge. The second spline portion has a longitudinally spaced plurality of second openings. Elongate inner binding means are provided for retaining one side edge of bound sheet material in an assembled portfolio between the first and second panels. The binding means have a longitudinally spaced plurality of inner detent means. An elongate outer spline member coacts with the inner binding means and has a longitudinally spaced plurality of outer detent means engagable with a plurality of the inner detent means. The first and second openings are spaced to align with the inner and outer detent means engagable through pairs of first and second openings in mutually overlapping sections of adjacent first and second spline portions.

17 Claims, 3 Drawing Sheets

1
2
14
15
16
17
18
20
6
7

TWO-PIECE PRESENTATION FOLDER

FIELD OF THE INVENTION

The invention relates to modular presentation binders and a kit for presentation folders which permits custom photocopying or other printing of small quantities of cover panels.

BACKGROUND OF THE INVENTION

Many paperboard folders have been conventionally made having a one piece construction formed to have a front panel a rear panel and optionally a pocket at a lower front portion of the rear panel. Such folders are used to assemble various printed materials in a convenient package format. It is also known to include binding apparatus for retaining sheet material as part of the folder either permanently or releasably between the front and rear panels. Conventional folders are frequently constructed of like cardboard or bristol board in order to provide a degree of protection for the bound sheet material.

Since it is desirable to provide printed material on the exterior of the front or rear panels, known paperboard folders include two piece folders in which the front and rear panels are separable to facilitate printing on standard photocopying or offset printing equipment without the need for large printing machinery required to print one piece folders. Such two piece folders are described in my U.S. Pat. Nos. 5,025,978 granted Jun. 25, 1991 and 5,104,250 granted Apr. 14, 1992.

The two piece folders of the patents are most advantageous for use as relatively simple paperboard folders to hold a minimal amount of sheets. The folders suffer from disadvantages associated with adhesives used to bind the elements together. One disadvantage is that the binder cannot practically be disassembled after being secured by the adhesive. Further such adhesives perform admirably when used with relatively simple folders however have some disadvantages when the folder is intended to have separable binder means to hold a large number of sheets. The weight of the sheets on the binder can be considerable. When used with a large number of sheets, the more widely spaced paperboard covers come to be placed under great loading in use on their edges and fold lines. In such an application a paperboard cover does not protect the enclosed sheets as well as in an application where such covers are closely spaced in a folder containing only a few sheets.

Of course, known three ring binders are known in which a substantial, one piece member of rigid vinyl covered cardboard forms the cover.

Such three ring binders suffer the disadvantages that they can not easily be printed and that their ring binders are applied to the cover with machinery.

The prior art suffers the disadvantage that folders are not known which have strength to advantageously protect a number of sheets secured in a binder yet can readily be printed by smaller printing establishments.

SUMMARY OF THE INVENTION

The invention overcomes the disadvantages of the prior art in a novel manner in the provision of a kit for assembly into a portfolio folder. The kit includes a separate first panel comprising a first rectangular sheet having a first elongate spline portion along a first side edge thereof delineated, from a remaining first rectangular portion of the first panel, by a hinge-forming scoreline parallel to the first side edge. The first spline portion has a longitudinally spaced plurality of first openings. The kit includes a like separate second panel comprising a second rectangular sheet having a second elongate spline portion along a second side edge thereof delineated, from a remaining second rectangular portion of the second panel, by a hinge-forming scoreline parallel to the second side edge. The second spline portion has a longitudinally spaced plurality of second openings. Elongate inner binding means are provided for retaining one side edge of bound sheet material in an assembled portfolio between the first and second panels. The binding means have a longitudinally spaced plurality of inner detent means. An elongate outer spline member coacts with the inner binding means and has a longitudinally spaced plurality of outer detent means engagable with a plurality of the inner detent means. The first and second openings are spaced to align with the inner and outer detent means engagable through pairs of first and second openings in mutually overlapping sections of adjacent first and second spline portions. The inner binding means and outer spline member are engaged respectively inward and outward of both said spline portions in the assembled kit.

Further provided in accordance with the invention is a method of manufacture of a portfolio folder with printed material on an outer surface thereof from a kit as described above. The method includes the following steps: applying printed material to at least one outer surface; assembling the first and second spline portions between the inner binding means and the outer spline member, wherein the hinge-forming scorelines of the first and second panels are positioned adjacent opposing long sides of the binding means and spline member; mutually aligning the first and second openings, and inner and outer detent means; and engaging the inner and outer detent means through a plurality of aligned pairs of first and second openings.

An advantage of folders constructed in accordance with the invention is that a rigid wear resistant spline is provided which enables use as the panels of relatively flexible, inexpensive and easily printed covering panels. A wear resistant spline is preferably manually assembled with the outer spline member clamping the first and second spline portions of the panels between the spline member and binding means. The spline member and binding means cooperate to support and reinforce the panels.

The hinge areas of the panels and corners of the spline of such folders are generally the areas where high stress and wear are experienced. The spline member and binding means preferrably are configured to sandwich the spline portions of the covers together in such a way as to support the covers. The invention provides a further advantage over conventional paperboard folders in that the spline member and binding means combine to provide a relatively hard spline area resistant to wear.

The preferred embodiment illustrated in the drawings includes a single central row of detent means. The spline member may be advantageously molded of plastic preferably having an outwardly convex initial cross-section. Such a built-in camber provides a spring locking or clamping action when detent means are engaged thereby further aiding in the clamping of the spline portions of the panels between the spline member and binding means in a secure fashion.

Alternatively two or more parallel rows of detent means may be provided to aid in the clamping of spline portions and providing increased support to the covers especially where relatively large widths of bound sheet material are assembled into a folder.

If desired, the manually engagable and disengagable detent means enables reuse of the binding means and spline member whereas the sheet material of the panels, being preferably constructed of paperboard materials, can be recycled easily.

The ability to assembly and if desired the portfolio folder, in addition to aiding in reusability of components, aids in shipping and packaging in that the panels may be shipped flat with the binding means and spline member separated in contrast to conventional three ring binders for example, which are shipped fully assembled.

The inner binding means preferably includes a rectangular bar of length and width substantially equal to those of a spline portion. In addition to the reinforcing features of such a bar, the binding means as such may accomodate any conventional means of binding sheet material in an assembled folder for example three ring mechanisms, multiple hole and ring combinations, or adhesive hot melt edge binding means.

Further aspects of the invention will become apparent upon review of the following detailed description.

BRIEF DESCRIPTION OF THE DRAWINGS

In order that the invention may be readily understood, a preferred embodiment of the invention will be described by way of example with reference to the accompanying drawings in which.

DETAILED DESCRIPTION OF PREFERRED EMBODIMENTS OF THE INVENTION

Figure 1:
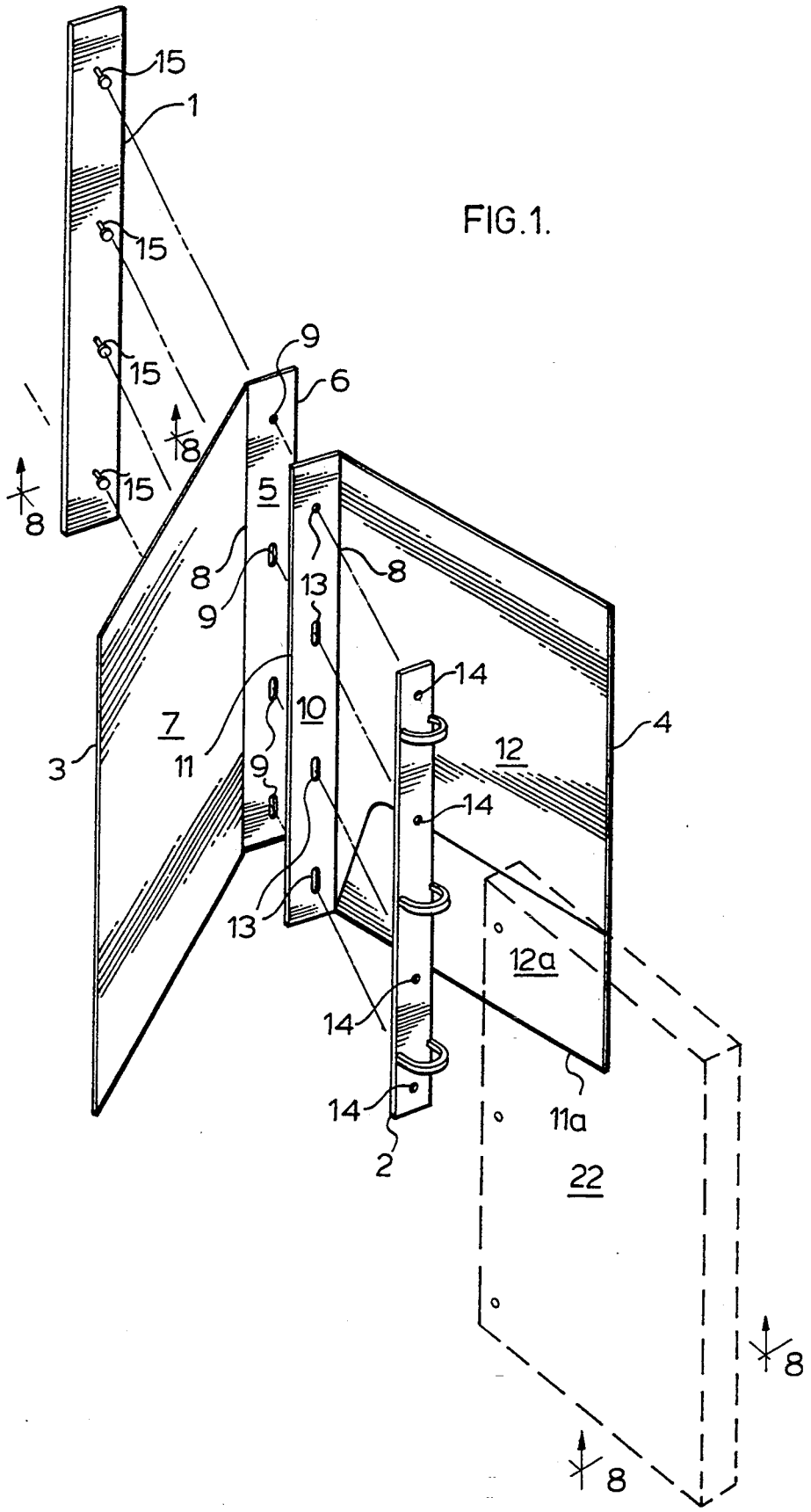
FIG. 1 is an exploded isometric view of an assembled folder showing the alignment and interconnection of detent means.

FIG. 1 illustrates an exploded view of a kit for assembly into a portfolio folder. The relative placement of components and the alignment of detent means and openings is shown. A preferred embodiment includes the outer spline member 1 and inner binding means 2 aligned so that their detent means engage by extending through the openings in spline portions of a separate first panel 3 and separate second panel 4. As shown, the first and second panels are substantially mirror images of each other however it will apparent to those skilled in the art that the teachings of the invention include numerous variations in respect of the relative designs of the panels 3 and 4.

The first panel 3 comprises a first rectangular sheet having a first elongate spline portion 5 along a first side edge 6. The first spline portion 5 is delineated from a remaining first rectangular portion 7 of the first panel 3 by a hinge forming score line 8 parallel to the first side edge 6. The first spline portion 5 has a longitudinally spaced plurality of first openings 9.

In a like manner a separate second panel 4 comprises a second rectangular sheet having a second elongate spline portion 10 along a second side edge 11. The second spline portion 10 is delineated from a remaining second rectangular portion 12 of the second panel 4 by a hinge forming score line 8 parallel to the second side edge 11. The second line portion has a longitudinally spaced plurality of second openings 13.

Optionally a panel 4 may include a reverse folded pocket portion **12*a* along a third edge 11*a***.

Elongate inner binding means 2 are provided for retaining one side edge of bound sheet material (not shown) in an assembled portfolio between the first and second panels 3 and 4. The binding means 2 have a longitudinally spaced plurality of inner detent means which in the embodiment illustrated comprise detent openings 14.

The elongate outer spline member 1 has a longitudinally spaced plurality of outer detent means which in the embodiment illustrated comprise mating pins 15.

The mating pins 15 are engagable with the detent openings 14 of the inner binding means 2. The first and second openings 9 and 13 are spaced to align with the mating pin 15 and detent opening 14 in mutually overlapping sections of the adjacent first and second spline portions 5 and 10. In the assembled portfolio folder therefore the binding means 2 and spline member 1 are respectively inward and outward of both spline portions 5 and 10 when engaged.

A portfolio folder with printed material on an outer surface may be manufactured from a kit as follows. Printed material may be applied to at least outer surface of the first or second panels 3 and 4. Preferably print material is applied by a photocopier or offset printer. The principle advantage of such kits for portfolio folders is that the panels are of such a size and material they may be easily printed upon with readily available photocopying or offset printing equipment as compared to folders of a single sheet which require special equipment in order to print the outer surfaces. In general the print material is applied to the outer surface of the first or second rectangular portions 7 and 12 however if desired any appropriate surface of the first or second panel 3 and 4 may be printed including the spline portions 5 and 10. For example if the spline member 1 is made of clear plastic, advantageous use of the folder may be made by also printing material upon the outer surface of the first spline portion 5.

After printing is applied, the first and second spline portions 5 and 10 are assembled between the inner binding means 2 and the outer spline member 1, as shown in exploded view FIG. 1. The hinge forming score lines 8 of the first and second panels 3 and 4 are positioned adjacent opposing long sides of the binding means 2 and spline member 1 respectively. In the embodiment shown the spline member 1 and binding means 2 each comprise a rectangular bar of length and width substantially equal to those of the spline portions 5 and 10.

The first and second openings 9 and 13 and the inner and outer detent means 15 and 14 are mutually aligned. The inner and outer detent means 14 and 15 are engaged through a plurality of aligned pairs of first and second openings 9 and 13. Preferably the inner and outer detent means 14 and 15 are constructed so as to be easily engaged manually without the use of tools. To lesser advantage in particular applications the engagement may be made in a permanent fashion possibly with the aid of machinery if neccessary.

Figures 2, 3, 4, 5:
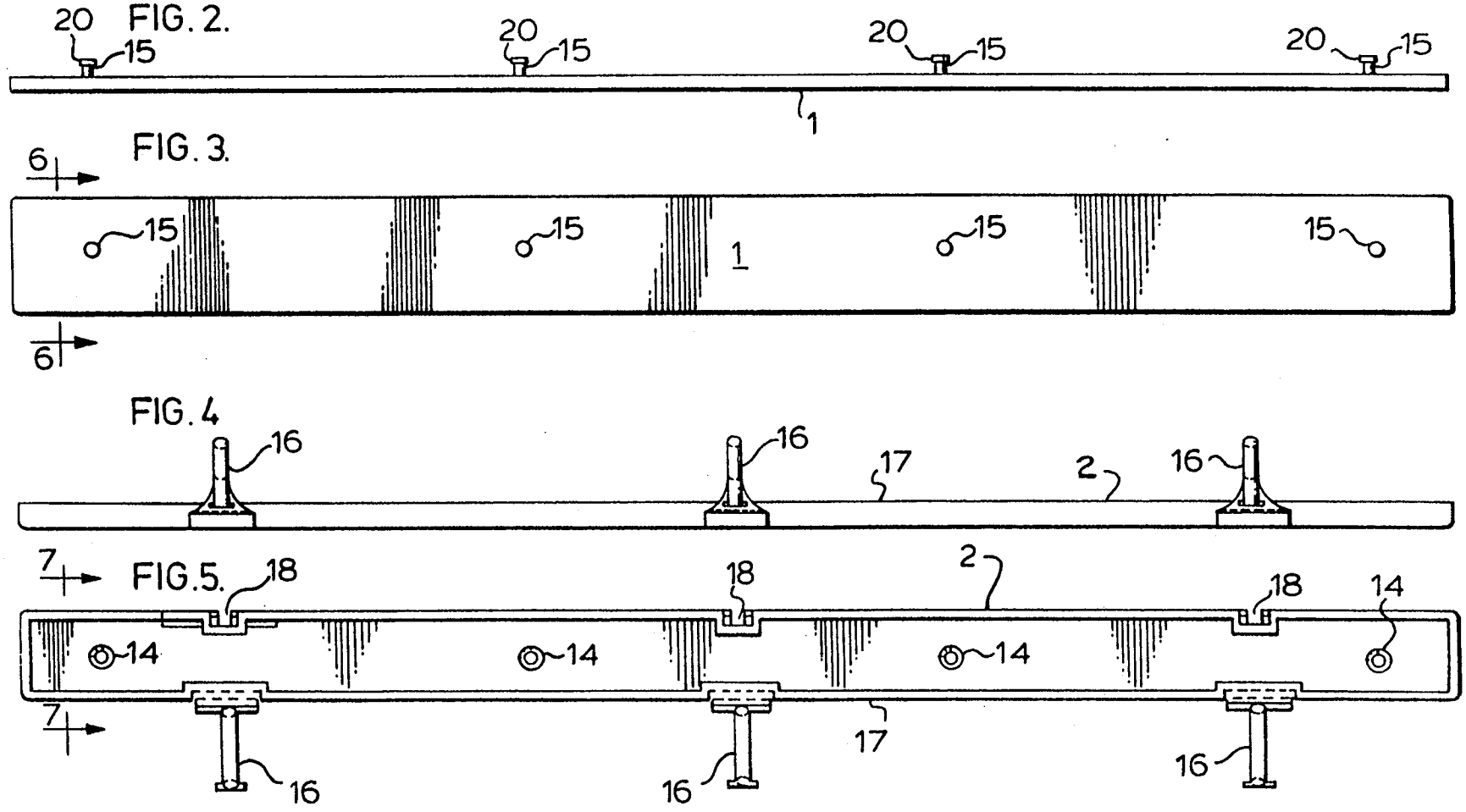
FIGS. 2 and 3 are respectively elevation and plan views of a spline member having four detent pins.
FIGS. 4 and 5 are respectively elevation and plan views of a plastic 3-ring binding member having four detent openings.
Figure 7:
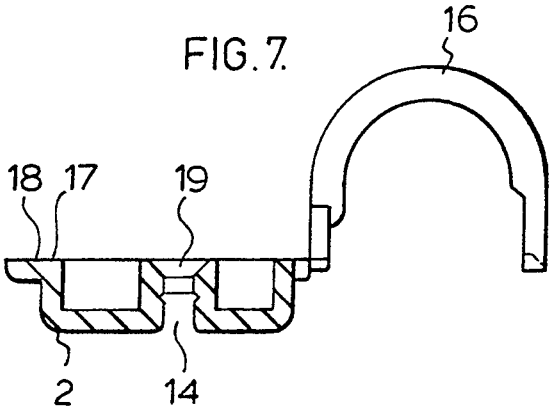
FIG. 7 is a sectional view along line 5—5 of FIG. 3.
Figure 8:
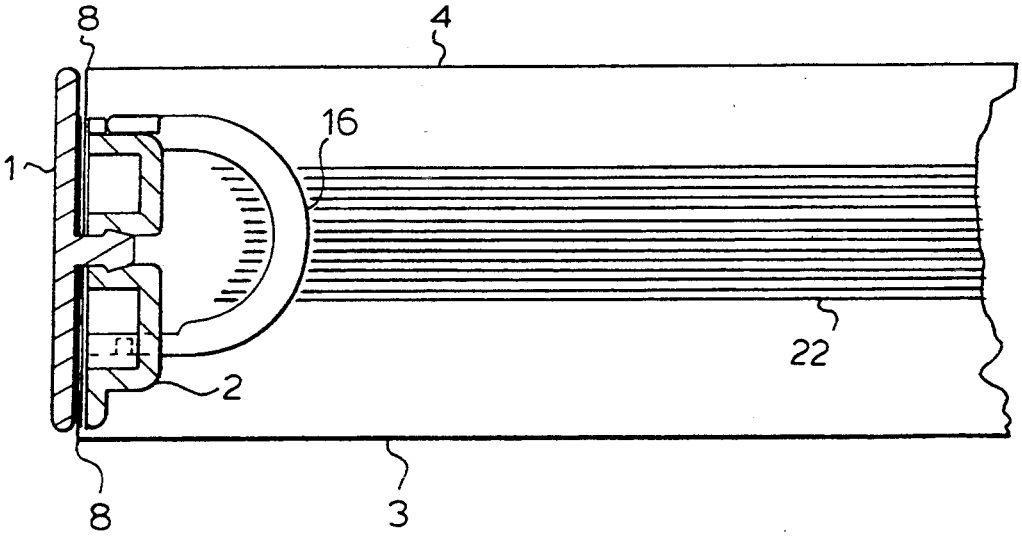
FIG. 8 is a sectional view, through an assembled portfolio folder.

FIGS. 4, 5 and 7 show details of the inner detent means 2 which in the embodiment shown is in the form of a three ring binding mechanism integrally formed of plastic. The inner detent means comprise detent-openings 14 which are configured to mate with the mating pins 15 of the outer spline member 1. As shown in FIG. 7, the binding means 2 comprise a rectangular bar having three longitudinally spaced apart transverse openable rings 16. Each ring 16 has one end flexibly integrally hinged to the bar 17 adjacent one long side of the bar 17. An opposite end of each ring 16 may be releasably locked to the bar 17 adjacent and opposite a long side of the bar 17. As shown in FIG. 4, locking means are provided on the opposite end of the ring 16 to engage a suitably configured slot 18 in the opposite side of the bar 17. The flexible nature of the plastic of which the binding means is constructed enables repeated hinging, locking and unlocking of each ring 16 independently.

Figure 6:
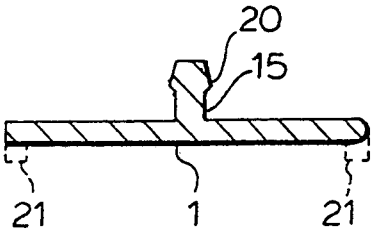
FIG. 6 is a sectional view along line 4—4 of FIG. 2.

FIGS. 2, 3 and 6 show details of the construction of the spline member 1. The outer detent means in the embodiment illustrated comprise mating pins 15 having resilient locking means engagable in a snap lock relation with an associated detent opening 14. An example of such resilient locking means is shown as a circumferential collar 20 about an inwardly projecting portion of an associated pin 15 inward of the binding means to when fully engaged. Examination of the detent openings 14 and mating pins 15 shown in FIGS. 6 and 7 reveals the means by which the inner and outer detent means are manually engagable in the relative sizing of the collar 20 and an associated shoulder portion 19 of the detent opening 14. The binding means and spline member are preferably selected such that, the inner and outer detent means may be easily manually engaged that is by the mere use of a persons hands without the need for any tools. The binding means and spline member may be designed such that they may not be disengaged or alternatively such that they may be disengaged for reuse.

In order to provide further rigidity as shown in FIGS. 2, 3 and 6 the spline member may include reinforcing edge ridges such as ridge 21 shown in dotted lines in FIG. 6. It will be apparent to those skilled in the are that such ridges 21 may take the form of inwardly or outwardly extending (as shown) edge ridges or a series longitudinal transversly spaced ridges on the outward surface of the spline member 1.

As can be seen from the above description of the invention a portfolio folder assembled in accordance with the above description provides several advantages over conventional folders. The spline member 1 and binding means 2 reinforce the spline area of the folder which in paper board folders is an area of considerable wear and stress due to hinging and handling of the folder. The binding means 2 and spline member 1 components may be reused to construct other folders using replacable panel members 3 and 4. The binding means 2 and spline member 1 may be recycled when constructed of appropriate plastic materials.

Preferably the folder is manually engagable which, as well as enabling printing of panel members with conventional photocopying or offset printing equipment, lends to ease of assembly and widespread accessibility to user of relatively short runs of printing. The use of binding means with a rectangular bar in addition to reinforcing the spline area enables use of any available means to bind one side edge of bound sheet material in an assembled portfolio. Although as illustrated a three ring binder is preferred the invention is also applicable to other known methods of binding sheet material.

Advantageously the separation of panels (3,4), binding means and spline member lends to ease of shipping and storage in that the panels may be packaged in flat form separate of the binding means 2 and spline member 1.

Although the detent means illustrated comprise a single longitudinal row the teachings of the invention include variations such as multiple rows of detent means and the possibility of transversly curving the spline member to increase its spring locking effect.

The preferred material for the covers is paperboard although a wide variety of other materials may be used including plastic sheet and vinyl sheet.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

I claim:

1. A kit for assembly into a portfolio folder comprising:

a separate first panel comprising a first rectangular sheet having a first elongate spline portion along a first side edge thereof delineated, from a remaining first rectangular portion of the first panel, by a hinge-forming scoreline parallel to the first side edge, the first spline portion having a longitudinally spaced plurality of first openings;

a separate second panel comprising a second rectangular sheet having a second elongate spline portion along a second side edge thereof delineated, from a remaining second rectangular portion of the second panel, by a hinge-forming scoreline parallel to the second side edge, the second spline portion having a longitudinally spaced plurality of second openings;

elongate inner binding means for retaining one side edge of bound sheet material in an assembled portfolio between the first and second panels, the binding means having a longitudinally spaced plurality of inner detent means; and an elongate outer spline member having a longitudinally spaced plurality of outer detent means engagable with a plurality of said inner detent means, said first and second openings being spaced to align when said first and second spline portions are in mutually overlapping relation with said inner and outer detent means engagable through pairs of aligned first and second openings, the inner binding means and outer spline member being engaged respectively inward and outward of both said first and second spline portions.

2. A kit according to claim 1 wherein the inner and outer detent means are manually engagable.

3. A kit according to claim 1 wherein the inner detent means comprise detent openings and the outer detent means comprise mating pins, the pins having resilient locking means engagable with an associated detent opening.

4. A kit according to claim 3 wherein the resilient locking means comprise a circumferential collar about an inwardly projecting portion of an associated pin inward of the binding means.

5. A kit according to claim 1 wherein the spline member comprises a rectangular bar of length and width substantially equal those of said first spline portion of the first panel.

6. A kit according to claim 1 wherein the binding means comprise a rectangular bar of length and width substantially equal those of said second spline portion of the second panel.

7. A kit according to claim 1 wherein the first and second spline portions are reverse images of each other.

8. A kit according to claim 7 wherein the spline member and binding means each comprise a rectangular bar of length and width substantially equal those of said spline portions.

9. A kit according to claim 1 wherein the binding means comprise a rectangular bar having three longitudinally spaced apart tranverse openable rings.

10. A kit according to claim 9 wherein the binding means is of plastic and wherein each ring has one end flexibly integrally hinged to said bar adjacent one long side of said bar, and an opposite end releasably locked to said bar adjacent an opposite long side of said bar.

11. A kit according to claim 1 wherein at least one of the first and second panels includes a reverse folded pocket portion along a third edge thereof.

12. A kit according to claim 1 wherein at least one of the first and second panels has an outer surface suitable for photocopying or offset printing.

13. A kit according to claim 12 wherein said outer surface is the outer surface of at least one of said first and second rectangular portions.

14. A method of manufacture of a portfolio folder with printed material on an outer surface thereof from a kit, said kit comprising:

a separate first panel comprising a first rectangular sheet having a first elongate spline portion along a first side edge thereof delineated, from a remaining first rectangular portion of the first panel, by a hinge-forming scoreline parallel to the first side edge, the first spline portion having a longitudinally spaced plurality of first openings;

a separate second panel comprising a second rectangular sheet having a second elongate spline portion along a second side edge thereof delineated, from a remaining second rectangular portion of the second panel, by a hinge-forming scoreline parallel to the second side edge, the second spline portion having a longitudinally spaced plurality of second openings, at least one of the first and second panels having an outer surface suitable for photocopying or offset printing;

elongate inner binding means for retaining one side edge of sheet material in an assembled portfolio between the first and second panels, the binding means having a longitudinally spaced plurality of inner detent means; and an elongate outer spline member having a longitudinally spaced plurality of outer detent means engagable with a plurality of said inner detent means through a like plurality of said first and second openings, the inner binding means and outer spline member being engaged respectively inward and outward of both said spline portions;

said method comprising:

applying printed material to at least one said outer surface;

assembling the first and second spline portions between the inner binding means and the outer spline member, wherein the hinge-forming scorelines of the first and second panels are positioned adjacent opposing long sides of the binding means and spline member respectively;

mutually aligning the first and second openings, and inner and outer detent means; and engaging the inner and outer detent means through a plurality of aligned pairs of first and second openings.

15. A method according to claim 14 wherein said inner and outer detent means are engaged manually.

16. A method according to claim 14 wherein the printed material is applied by a photocopier or offset printer.

17. A method according to claim 14 wherein printed material is applied to at least one of an outer surface of said first and second rectangular portions.

* * * * *